United States Patent [19]

Webster

[11] Patent Number: 4,874,136

[45] Date of Patent: Oct. 17, 1989

[54] PULP REFINING APPARATUS

[76] Inventor: David R. Webster, 32 Forden Avenue, Westmount, Quebec, Canada, H3Y 2Y8

[21] Appl. No.: 148,167

[22] Filed: Jan. 22, 1988

Related U.S. Application Data

[63] Continuation of Ser. No. 895,749, Aug. 12, 1986, abandoned, which is a continuation of Ser. No. 629,560, Jul. 10, 1984, abandoned, which is a continuation of Ser. No. 311,251, Oct. 14, 1981, abandoned.

[30] Foreign Application Priority Data

Sep. 30, 1981 [CA] Canada ..... 387,006

[51] Int. Cl.[4] ..... B02C 7/12

[52] U.S. Cl. ..... 241/251; 241/260; 241/261; 241/261.1; 241/296

[58] Field of Search ..... 241/28, 30, 244, 250, 241/251, 260, 260.1, 261, 261.1, 261.2, 296

[56] References Cited

U.S. PATENT DOCUMENTS

| | | | |
|---|---|---|---|
| 76,270 | 3/1868 | Taggart | 241/261.1 X |
| 293,047 | 2/1884 | Machey | 241/261.1 X |
| 1,705,379 | 3/1929 | Sheppard, Jr. | 241/296 |
| 4,039,154 | 8/1977 | Peterson | 241/261.3 |

FOREIGN PATENT DOCUMENTS

| | | | |
|---|---|---|---|
| 2202798 | 8/1973 | Fed. Rep. of Germany | 241/296 |

*Primary Examiner*—Timothy V. Eley

*Attorney, Agent, or Firm*—Charles E. Brown; Charles A. Brown

[57] ABSTRACT

A pulp refiner has a pair of refiner members with opposed surfaces each including alternating grooves and lands extending between a central port and a peripheral port through which a pulp slurry is passed. The edges of the lands define work edges. Drive means are provided for rotating at least one of the members relative to the other. The grooves and lands defined in at least one member extend from the central to the peripheral port in a spiral pattern having a direction on the member from one port to the other relative to the direction of rotation which will provide a screw pump action to the pulp slurry as it advances from one port to the other. The pitch of the spiral lands forming the work edges on the opposed surfaces of the respective refiner members is such that the intersection of the opposed work edges defines an obtuse angle on the downstream side of the lands relative to the direction of rotation and flow such that pulp fibers suspended in the pulp slurry will be subjected to a pinching action.

4 Claims, 2 Drawing Sheets

20
5
6
10
4
1
2
3

8
7

A
B 21
22
30
C
24
23

PULP REFINING APPARATUS

CROSS-REFERENCE TO RELATED APPLICATION

This application is a continuation application of U.S. patent application Ser. No. 895,749, filed Aug. 12, 1986, which is a continuation application of Ser. No. 629,560, filed Jul. 10, 1984 (now abandoned), which is a continuation application of Ser. No. 311,251, filed Oct. 14, 1981 (now abandoned).

BACKGROUND OF THE INVENTION

1. Field of Invention

The present invention relates to improvements in apparatuses for the refining of pulp as well as to a method for the refining of pulp in a paper making process.

2. Description of Prior Art

Disc refining dates from antiquity with the preparation of food and drink. Modern disc patterns reflect that ancient art by still having patterns of many straight or slightly-curved lines that impact a paddle-like action on the material. The paddle-like action, at high speed, creates impacts accompanied by much noise, fast wear and energy loss.

Some of the known grinding mills utilize parallel cylinders with spiral teeth. Those on one cylinder intermesh with the teeth of the other, the teeth serving for one cylinder to drive the other. That is, the teeth act as helical gears, and material such as pulp is mashed at these gears. In other known apparatuses, the helical grooves or ribs of a rotor may have variable pitch for urging material along a smooth casing that is cylindrical or conical. Some helical apparatuses with uniform pitch specifically avoid intermeshing such as discussed in Krone's U.S. Pat. No. 3,197,147, Col 3, line 66. Such cylindrical and conical apparatuses have substantially co-axial rotors. Disc refining normally has co-axial positioning of the rotors, one disc either rotating opposite from the other or being held stationary or being rotated at a slower speed in the same direction. In each instance, refining is achieved by a difference of rotational speed between two discs, one disc rubbing the other through a layer of material being refined. Thus, two co-operating discs do not mesh together, and instead the difference of rotational speed creates shear planes that help to refine material. Known disc refining utilizes patterns of many short and substantially radial lines that impart a paddle-like action on material being refined.

The results of such refiner patterns are high noise levels, rapid wear and power loss. Heat generated from the resultant friction absorbs so much energy that a cooling system is commonly used. Substantially radial paths allow material to eject too readily centrifugally from the periphery of the discs.

Some disc apparatuses attempt to reduce this ejection by including small dams at various places between the radial ribs while other apparatuses are designed to reduce the effect of rapid centrifugal ejection by recirculation of the material being refined. However, recirculation requires enlargement of the apparatus to accommodate both main flow and recycled flow.

SUMMARY OF THE INVENTION

The present invention aims to help overcome these problems of prior art and to improve the refining action.

An apparatus, in accordance with the present invention, comprises a pulp refiner having a pair of refiner members with opposed surfaces each including alternating grooves and lands extending between a central port and a peripheral port through which a pulp slurry is passed. The edges of the lands define work edges. Drive means are provided for rotating at least one of the members relative to the other. The grooves and lands defined in at least one member extend from one of the central and peripheral ports to the other of the ports in a spiral pattern having a direction on the member from one port to the other relative to the direction of rotation which will provide a screw pump action to the pulp slurry as it advances from one port to the other. The pitch of the spiral lands forming the work edges on the opposed surfaces of the respective refiner members is such that the intersection of the opposed work edges defines an obtuse angle on the downstream side of the lands relative to the direction of rotation and flow such that pulp fibers suspended in the pulp slurry will be subjected to a pinching action.

The present invention discloses refining land or ribs or edges disposed substantially circumferential whereas in known disc refining they are disposed substantially radial.

The paddle-like action of known disc refiner plates is replaced by a screw-like action in this invention, yielding a pinching on material being refined, instead of known abrupt and noisy chisel-like impact on material.

A gap between rotor and stator or between two rotating discs is controlled in part by the screw action on material positively advancing the same, helping to increase or decrease flow pressure between the two refining surfaces. This controllable flow pressure variably forces the work surfaces apart and affects the refining action between the two co-operating work surfaces. The resulting "push" may be related to that of an Archimedes screw or scroll conveyor.

The ribs of co-operating surfaces in some embodiments of the present invention, are few continuous and long, versus work edges of known disc plates.

The lands may be formed by drawn wire. The wire becomes the work edge. In order to provide even greater strength, the drawn wire may be carbon steel or other high strength steel alloy. The steel may be heat hardened. Of course, the spiral land may be cast, if desired.

Wire also affords for continuous fabrication processes that are less costly than known intermittent fabrication processes.

In the present invention, intersections of spiral work edges of two opposed discs provide a plurality of contacts simultaneously pinching material in a sliding grip. As well, a sliding pinch action at a feather angle on material reduces wear and power loss.

Radial land of known disc refining have wear at both edges of a refining line. The leading edge is worn by impact, while the trailing edge is worn by cavitation. The present invention introduces a refiner work edge to a next work edge gradually, avoiding the trailing turbulent drag of known refiner work edges.

Welded drawn wires are known for their great strength-to-weight ratio compared to castings and other types of metal assembly. The wire of a mere paper clip has unit strength far beyond the unit strength of structural steel. Large gun barrels have wire winding to withstand the great and sudden forces of explosions.

Wire formed lands are made from round wire mainly, but other shapes such as square, rectangular, hexagonal, oval and grooved are available. Attachment of wire to a refiner disc normally would be by welding but other suitable methods may be used.

The present invention also overcomes the centrifugal problem of material ejection at a disc periphery, by replacing radial refining edges with spiral edges. A spiral land for refining may be arranged for clockwise or counter clockwise rotation.

Some new results from the present invention are seen to derive from an intersecting phenomenon accompanying outward radial flow between two parallel discs. When cross-sectional areas of flow are examined one sees that a flow front grows as an expanding circle. For a constant distance between two discs, i.e. a gap of uniform flow thickness, and non-elastic fluid such as water, outward radial flow decreases in speed directly with distance outward on a radius.

According to the Bernouilli Theorem, total energy of a flowing liquid remaining constant and ignoring friction, a change of flow cross-section is accompanied by a conversion of energy between velocity and static pressure. In outward radial flow between radial discs velocity is maximum at disc center, minimum at disc periphery. Static pressure accordingly is less at disc center than at circumference. With a discharge at atmospheric pressure the static pressure everywhere in the gap is less. As a result, instead of flow spreading the discs apart, atmospheric pressure presses them together.

The fluid phenomenon is modified with solid material in fluid suspension, because solid particles momentarily lodge between discs and retard flow, similar to wall friction retarding flow. But the Bernouilli principle still applies, and while conversion from core velocity to peripheral static pressure is merely energy conversion, reduction of solid particle size is energy consuming. Well known in all refining is the fact that small particles flow freely through a work zone and only large particles lodge against work lines and are reduced in size.

Known disc refining apparatuses obscure this fluid-pressure phenomenon by the fact that radial work edges produce increased pressure surges since they act as centrifugal pump vanes. Although disc peripheral velocity is as great in the present invention as in known disc refiners of equal size, virtual elimination of vane pumping action leaves only wall friction in the present invention to produce a minor pumping effect to counter partially the Bernouilli energy conversion.

Also known, disc refiners frequently are dished to have a wider gap near the disc center than at the disc periphery, and the gap taper tends to maintain high outward velocity and diminish rate of fluid energy conversion. As is well known, outward radial flow has a direction that is a result of a radial and a circumferential component. When identical disc patterns cooperate in opposite rotations at a common speed, the circumferential components exactly cancel one another, leaving average outward flow straight along a radius.

In known disc refining, many abrupt changes in flow cross-section cause downstream eddies as severe turbulence, with consequent major loss of fluid energy. In the present invention by contrast, substantial alignment of work lines with rotary travel avoids such abrupt enlargement of flow section, thereby conserving most available fluid energy.

Thus a new result of the present invention is that virtual elimination of the pumping action, by elimination of radial vanes lets the Bernouilli principle be felt. The present invention accordingly exhibits a low-pressure discharge. An accompanying new result is that energy absorbed by pumping in prior art is released for refining in the present invention.

From the Bernouilli principle, an interesting result is that sub-atmospheric pressure generated between discs may be utilized in combination with external atmospheric pressure, as a differential pressure urging discs against material to be refined.

Another interesting phenomenon of the screw action of the present invention is that spiral work edges advance somewhat like a standing wave or screw thread, introducing a new and useful parameter, a clearly-defined advance of work edge intersections, for measuring refiner effect on material between co-operating discs.

For example, two identical spirals at equal but opposite rotations have work-edge intersections that advance straight along a radius. In the present invention, investigation of intersections is relatively simple that is, by drawing two spirals on top of each other. Number and location of intersections are seen to derive from pitch, lead and number of turns in both spirals. For one rotation, advance of each intersections is seen as a parameter for helping to determine refining results for various operating conditions. This means of investigating intersections provides a direct basis for co-relating refining results on material.

The present invention has work lines with clearly-defined intersections, almost constant speed of intersections because a screw action provides a common type of advance near center and periphery, and virtual elimination of leakage around ends of work edges since the instant edges are long as well as being spiral.

It is an object of the present invention to provide a method and apparatus for minimal impacts and noise in refining thereby reducing wear and power compared to known disc refining.

It is a further object to reduce wear from pitting, at a departure of refiner lines, by utilizing work lines that are substantially spiral thereby minimizing turbulence, a source of pitting in the wake of a travelling radial work line.

It is a further object to provide a gradual pinch by continuous sliding action between discs by curving a long "knife", as a spiral of several turns, in the small space of a disc to co-operate with a mating disc.

It is a further object to provide a space between spiral work lines, or "knives", that together form a continuously expanding cell between dams screwing material outward from disc center toward circumference.

It is a further object to make possible inward flow by selecting rotational direction and hand of spiral.

It is a further object to introduce by screw action a positive displacement, thereby a control on flow rate, to overcome a tendency for known radial lines to eject material by centrifugal force.

It is a further object to utilize the great tensile strength of steel, when drawn as wire, by firmly attaching wire as lands on co-operating faces of refiner discs.

It is a further object to utilize additional strength available for steel wire by the addition of alloying elements in the steel and even further strength by the addition of heat treatment of the wire.

It is a further object to control flow rate in part by selection of, size, lead, pitch and rotational speed of the wire.

It is a further object to provide a method for disc refining which is also applicable to conical refining.

In a still further aspect of the present invention there is provided a method of refining material comprising the steps of: providing a pair of work refining surfaces, together being capable of providing a screw-like and sliding-pinching action to material to be refined thereby; rotating at least one of said work refining surfaces relative to the other; and introducing the material to be refined between said work refining surfaces, thereby applying a smooth, low-audible, screwlike, sliding-pinching action to said material by the rotation of said work refining surface.

In a still further aspect of the present invention there is provided a method of controlling, in a refining apparatus, the gap between the rotor and stator or between, for example, two rotating discs having work refining surfaces, comprising the step of providing a screw-like action on the material being refined, i.e. between said discs, thereby causing a positive advancing action to aid increase or decrease flow pressure between the respective refining work surfaces.

In a still further aspect of the present invention there is provided a method of controlling, at least in part, flow rate, when refining a material using a refining apparatus having a rotating spiral refining means, comprising the step of selecting the size, lead, pitch and rotational speed of said spiral refining means.

BRIEF DESCRIPTION OF THE DRAWINGS

The invention is illustrated by way of example in the accompanying drawings wherein.

DESCRIPTION OF PREFERRED EMBODIMENTS

It will be also appreciated the spiral principle according to the present invention, besides being utilized as a plate or cone, can be utilized as a cylinder wherein the refining lines describe a helix.

A rotating spiral on a cone urges materials in one direction to thrust rotor toward stator, as a method and means of increasing refining pressure. Alternatively, the spiral could urge material in an opposite direction to thrust rotor away from stator, as a method and means of reducing refining pressure.

The term "lead" in these examples is analogous to a "lead" in common screw threads where "lead" is the axial distance advanced by one rotation of a thread. On a disc the lead would correspond to the radial distance of any given spiral land. Pitch is the distance between threads. In a single sprial land, as in FIG. 1, "pitch" and "lead" are equal. The single land configuration can have as many turns as desired. In a double thread, as in FIGS. 2 and 3, the lead is twice the pitch. In a triple land configuration, the lead is three times the pitch. Again, multiple lead can extend with as many turns as desired, and in FIG. 4 therefore no limit is shown on number of turns.

Refiner plates according to this invention need only one direction of spiral, because tipping any plate to face an identical plate reverses the image, whereby two identical plates would intersect at their raised spiral portions and not interlock.

Figures 1, 2, 3, 4, 5:
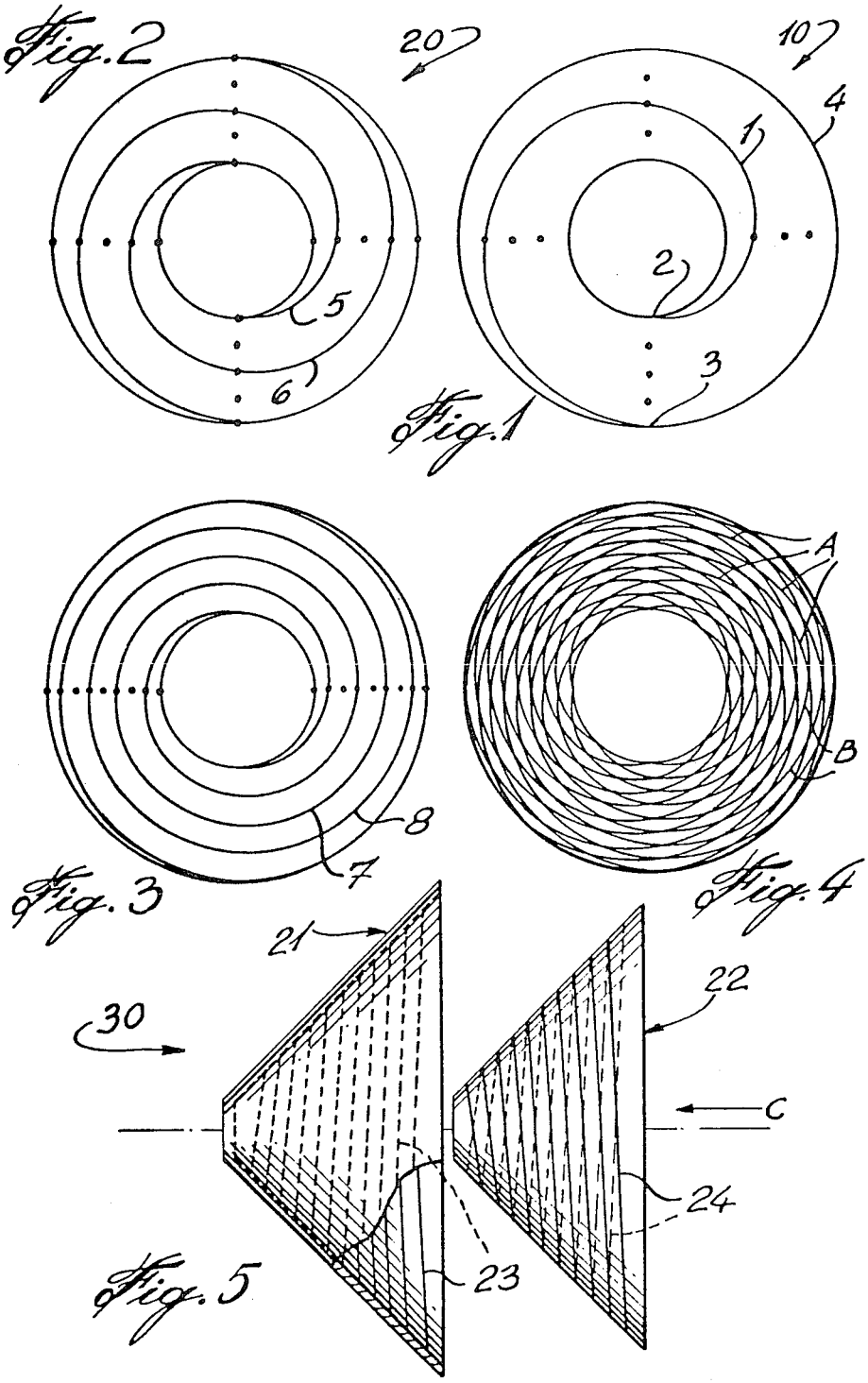
FIG. 1 is a diagrammatic view showing one plate with single lead and single turn of a spiral pattern.
FIG. 2 is a diagrammatic view showing one plate with double lead and single turn of a spiral pattern. Leads are shown 180° apart.
FIG. 3 is a diagrammatic view showing one plate with double leads 180° apart and two turns of a spiral pattern.
FIG. 4 is a diagrammatic view showing two plates, multiple lead of both plates shown near circumference with some intersections by way of example. Multiple spiral turns are omitted for reasons of clarity and accordingly not shown since the nature of many turns is clearly evident.
FIG. 5 is a diagrammatic exploded view showing a side view of a conical stator and rotor.

FIG. 1 discloses the working face of one disc 10 of a refining apparatus having a single land, single turn. Thus, the disc comprises an arrangement having a radially extending refining edge 1 which extends continuously and uninterruptedly from a first point 2 generally centrally of the disc to a second point 3 adjacent or at the periphery of the disc 10.

Thus, when a companion disc (not shown) similar to disc 10 except for direction of the spiral is mounted in spaced relation to disc 10, in well known manner an intersection is provided between the refining edges of the respective discs that imparts a sliding-gripping-pinching action to material introduced between the respective discs. FIG. 4 exemplifies the intersections when two discs face one another.

In the case of a preferred embodiment, the disc of FIG. 1 and companion disc comprise a refining edge 1 constructed from a wire or the like material welded or the like in place to the disc body 4.

Attention is directed to FIG. 2 showing a further embodiment of disc 20 having a pair of spiral lands having a single turn and defining respective edges 5 and 6, similar to edge 1 shown in FIG. 1. Edges 5 and 6 have starting points at 180° apart. The disc of FIG. 3 includes refining edges 7 and 8 each with starting and finishing points spaced 180° apart.

FIG. 3 discloses a further embodiment similar to that of FIG. 2 in that a pair of lands are provided but wherein the lands have two turns on the disc.

Referring once more to FIG. 4, it will be seen that the refining edge A on one disc intersects refining edge B on the companion disc to provide an intersection. Such intersection, as indicated previously imparts a sliding-gripping-pinching action to the material introduced between the discs when each is revolving.

In FIG. 5 there is shown an arrangement 30 having a stator 21 and rotor 22 each having respectively circumferentially extending refining edges 23 and 24 in spiral configuration and which extend continuously, axially from end to end.

Thus, it will be appreciated from the foregoing that the present spiral arrangements apply readily to disc type refiners, concial and cylindrical refiners (not shown).

Other embodiments according to the present invention, similar to the ones discussed above, may be provided, variations being made in the size, lead, pitch and rotational speed of the spirals, including varying the speed rotation between one disc or the like and companion disc or the like.

Figure 6:
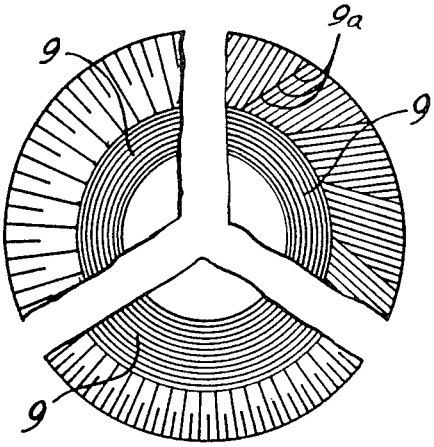
FIGS. 6, 7 and 8 illustrate the spiral arrangements in accordance with the present invention, further illustrating they may be combined with conventional patterns to provide spiral lines near the inner, mid or outer radius of a plate.
Figure 7:
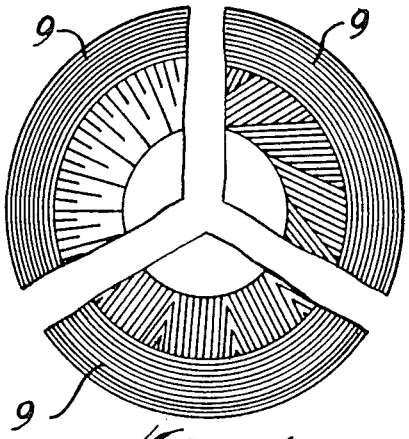
Figure 8:
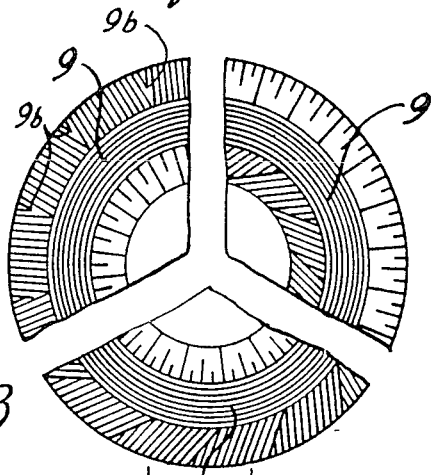

Further modifications of the embodiments discussed above may also be made in order to obtain other aspects according to the invention. Such include interrupting the refining edges of the spirals to intersect other refining edges. Examples of some patterns which may be used are exemplified in FIGS. 6, 7 and 8. Nine different combinations of examples are shown, three respectively in each of the figures. The circumferentially extending refining edges are denoted by number 9 in each figure and as seen may be selectively located on a disc, for example at the periphery as indicated in FIG. 7; at the inner area as indicated in FIG. 6 or intermediate position thereof as indicated in FIG. 8. As further seen, a combination of spiral and/or straight radial refining edges may also be utilized therewith. Attention is further directed to the figures showing a combination of relatively long and short radially extending refining edges. Still others it will be noted converge to form apex edges. In some instances, at least one of each combination of types of refining edges may be present in a given refining member.

Figure 11:
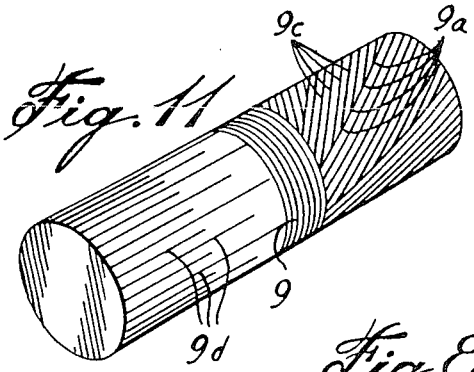
FIG. 11 is a diagrammatic view of a cylindrical surfaced rotor member with spiral and radial refining lands.

FIG. 11 illustrates a cylindrical surfaced rotor member which comprises on its refining surface a combination of spiral and radial refining lands having edges designated respectively by numerals 9, 9*c*, and 9*d*. Refining edges 9*c* and 9*d*, it will be noted, are noncircumferentially extending refining edges of differing types, again being but two examples of types which may be utilized. It will be realized that the companion stator may have similar matching mirrored types of refining edges thereon.

Figure 9:
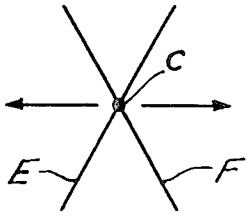
Fig. 9 (PRIOR ART)
FIGS. 9 and 10 illustrate diagrammatically the behaviour of a locus point at the intersection of the refining members respectively in the case of the prior art and the present invention.
Figure 10:
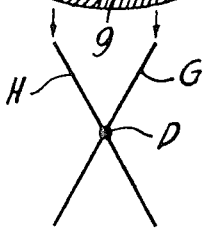

Attention is directed to FIGS. 9 and 10, illustrating diagrammatically the behaviour of respective locus points C and D at the intersection of the respective refining edges E,F and H,G. These figures help to bring an understanding of why a relatively low noise occurs during operation of the apparatus according to the invention. In the case of the prior art devices, the locus point C moves and in the case of the devices according to the present invention, the locus point D remains stationary. This is explained by the fact that there is substantially parallel movement of the refining edges as indicated by the arrows in FIG. 10 versus definite axial movement of the refining edges in the case of the prior art devices as indicated by the arrows in FIG. 9.

Regarding operation of the refining apparatus in accordance with the present invention, pulp to be refined is introduced in any suitable known manner to the various embodiments, intermediate the parts comprising the refining unit, i.e. between the opposed refining edges of the respective cooperating parts. For example, in the case of a pair of disc members, between the same. One disc may if desired, remain stationary while the other companion one rotates. Alternatively, both discs rotate in counter-directions and while the disc or discs are in motion, the material is of course fed from the center. During the ensuing material refining process and especially in the case of the preferred embodiments having parts with continuously extending and uninterrupted long refining edges, for example ones shown in FIGS. 1 through 3, a sliding-gripping-pinching action is applied to the material by the edge intersections of the respective mating refining edges and whereby relatively quiet and efficient refining action is provided, compared so that provided by the apparatus of the prior art.

I claim:

1. In a high speed pulp refiner having a pair of refiner members having opposed surfaces defining a gap, each member formed with alternating grooves and lands extending continuously between a central port and a peripheral port through which a pulp slurry flows, the edges of the lands defining work edges, the direction of the work edges on one surface being opposite to the direction of work edges on the opposed surface forming intersections therewith, drive means for rotating at least one of the members relative to the other, the grooves and lands defined in the at least one member extending from the one of the central and peripheral ports to the other of said ports in a spiral pattern of at least one revolution having a direction on the member from one port to the other which is opposite to the direction of rotation such that as the at least one member rotates, the intersections will move downstream which will provide a screw pump action to the pulp slurry as it advances from one port to the other, the pitch of the spiral lands forming the work edges on the opposed surfaces of the respective refiner members being such that each of the intersections of the opposed work edges defines an obtuse angle on the downstream side of the lands relative to the direction of rotation and pulp slurry flow such that the pulp fibers suspended in the pulp slurry will be subjected to a pinching action.

2. In a pulp refiner as defined in claim 1, wherein the pair of refiner members are in the form of planar discs, and the central port is the inlet port for the pulp slurry while the peripheral ports are the discharge or outlet ports at the periphery of the refiner plates, the spiral work edges extend in a direction opposite to the direction of rotation of the at least one rotating refiner plate, and in any event, the spiral working edges on opposite surfaces extend in opposite directions relative to each other such that the angle of intersection defined by working edges on lands facing outwardly of the discs is an obtuse angle, and the selection of pitch, lead and the number of revolutions of the spiral lands and grooves is such that as the slurry moves from the central inlet port to the peripheral outlet port by means of the screw pump action, the velocity of the slurry decreases from the inlet port to the outlet ports causing static pressue thereof to be increased towards the periphery of the discs such that the refiner discs will be urged towards each other by atmospheric pressure, particularly in the peripheral area thereof, thus increasing the refining action on the pulp and reducing the power requirements thereof.

3. A pulp refiner as defined in claim 1, wherein the pair of refiner members are conical in shape.

4. A pulp refiner as defined in claim 1, wherein the spiral work edges comprise a wire material positively secured on the surfaces of the respective refiner members, the wires defining the lands and grooves therebetween.

* * * * *